US009669456B1

(12) United States Patent
Turner

(10) Patent No.: US 9,669,456 B1
(45) Date of Patent: Jun. 6, 2017

(54) DIE FOR SWAGE PRESS

(71) Applicant: AFL Telecommunications LLC, Duncan, SC (US)

(72) Inventor: Kelvin Turner, Duncan, SC (US)

(73) Assignee: AFL Telecommunications LLC, Duncan, SC (US)

( * ) Notice: Subject to any disclaimer, the term of this patent is extended or adjusted under 35 U.S.C. 154(b) by 0 days.

(21) Appl. No.: 15/256,876

(22) Filed: Sep. 6, 2016

(51) Int. Cl.
*B21D 39/04* (2006.01)
*B21J 9/06* (2006.01)

(52) U.S. Cl.
CPC ..... *B21J 9/06* (2013.01); *B21D 39/04* (2013.01); *B21D 39/046* (2013.01); *B21D 39/048* (2013.01)

(58) Field of Classification Search
CPC ..... B21J 9/06; B21D 39/04; B21D 39/048; B21D 39/046
USPC ..... 72/469, 402
See application file for complete search history.

(56) References Cited

U.S. PATENT DOCUMENTS

| | | | | |
|---|---|---|---|---|
| 3,848,451 | A * | 11/1974 | Allin | B21D 39/046 29/237 |
| 5,069,058 | A | 12/1991 | Hyatt | |
| 7,299,674 | B2 * | 11/2007 | Palejwala | B21D 39/048 29/237 |
| 9,085,023 | B2 * | 7/2015 | Danhash | B21D 39/04 |
| 2014/0020226 | A1 | 1/2014 | Danhash et al. | |
| 2014/0237797 | A1 | 8/2014 | Danhash et al. | |

* cited by examiner

*Primary Examiner* — David B Jones
(74) *Attorney, Agent, or Firm* — Dority & Manning, P.A.

(57) ABSTRACT

A swage die includes a plurality of teeth aligned in a generally arcuate array. Each tooth of the plurality of teeth includes a first sidewall, an opposing second sidewall, a first endwall, and an opposing second endwall. The swage die further includes a plurality of first supports, each of the plurality of first supports extending between and connected to first endwalls of neighboring teeth, and a plurality of second supports, each of the plurality of second supports extending between and connected to second endwalls of neighboring teeth. The swage die further includes a plurality of stops, each of the plurality of stops extending from the first sidewall of a tooth towards the second sidewall of a neighboring tooth or from the second sidewall of a tooth towards the first sidewall of a neighboring tooth.

20 Claims, 5 Drawing Sheets

DIE FOR SWAGE PRESS

FIELD OF THE INVENTION

The present disclosure relates generally to swage presses, and more specifically to improved swage dies for use in swage presses.

BACKGROUND OF THE INVENTION

Swaged fittings are generally known for connecting tubes together to form generally fluid-tight connections between the tubes. Swage presses are generally utilized to press the tubes and fitting together and form such fluid-tight connection. Tubes are assembled together, and a fitting is provided at a connection point between the tubes. This assembly is provided into a swage press. A die block of the swage press may compress the fitting on to the tubes, forming the swaged fitting and thus connecting the tubes. Swaged fittings can also be utilized in other various scenarios, such as on stranded cables or rods.

One concern with known swage presses is the stresses experienced by the dies utilized in the die block. If the compression pressures utilized to form a swaged fitting are too high, the dies can be damaged and fail. In some cases, full swage press strokes are thus not utilized due to concerns that the resulting high pressures will result in die failure.

Accordingly, improved swage dies and swage presses are desired in the art. In particular, swage die designs which provide decreased stresses at high compression pressures, and which can be utilized in swage presses that perform full strokes, would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a swage die is provided. The swage die includes a plurality of teeth aligned in a generally arcuate array. Each tooth of the plurality of teeth includes a first sidewall, an opposing second sidewall, a first endwall, and an opposing second endwall. The swage die further includes a plurality of first supports, each of the plurality of first supports extending between and connected to first endwalls of neighboring teeth, and a plurality of second supports, each of the plurality of second supports extending between and connected to second endwalls of neighboring teeth. The swage die further includes a plurality of stops, each of the plurality of stops extending from the first sidewall of a tooth towards the second sidewall of a neighboring tooth or from the second sidewall of a tooth towards the first sidewall of a neighboring tooth.

In accordance with another embodiment, a swage die is provided. The swage die includes a plurality of teeth aligned in a generally arcuate array. Each tooth of the plurality of teeth includes a first sidewall, an opposing second sidewall, a first endwall, and an opposing second endwall. The swage die further includes a plurality of first supports, each of the plurality of first supports extending between and connected to first endwalls of neighboring teeth, and a plurality of second supports, each of the plurality of second supports extending between and connected to second endwalls of neighboring teeth. The swage die further includes a top surface and a bottom surface. The bottom surface includes a first end portion extending from a first end, a second end portion extending from a second end, and an intermediate portion extending between and connecting the first end portion and the second end portion. The intermediate portion has a generally constant radius. The first end portion and the second end portion each extend at a generally constant angle from the intermediate portion.

In accordance with another embodiment, a swage press is provided. The swage press includes a cylinder including a housing and a piston, and a die block connected to the cylinder. The die block includes a head, a jaw, and a plurality of dies. Each of the plurality of dies includes a plurality of teeth aligned in a generally arcuate array. Each tooth of the plurality of teeth includes a first sidewall, an opposing second sidewall, a first endwall, and an opposing second endwall. Each of the plurality of dies further includes a plurality of first supports, each of the plurality of first supports extending between and connected to first endwalls of neighboring teeth, and a plurality of second supports, each of the plurality of second supports extending between and connected to second endwalls of neighboring teeth. Each of the plurality of dies further includes a plurality of stops, each of the plurality of stops extending from the first sidewall of a tooth towards the second sidewall of a neighboring tooth or from the second sidewall of a tooth towards the first sidewall of a neighboring tooth.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
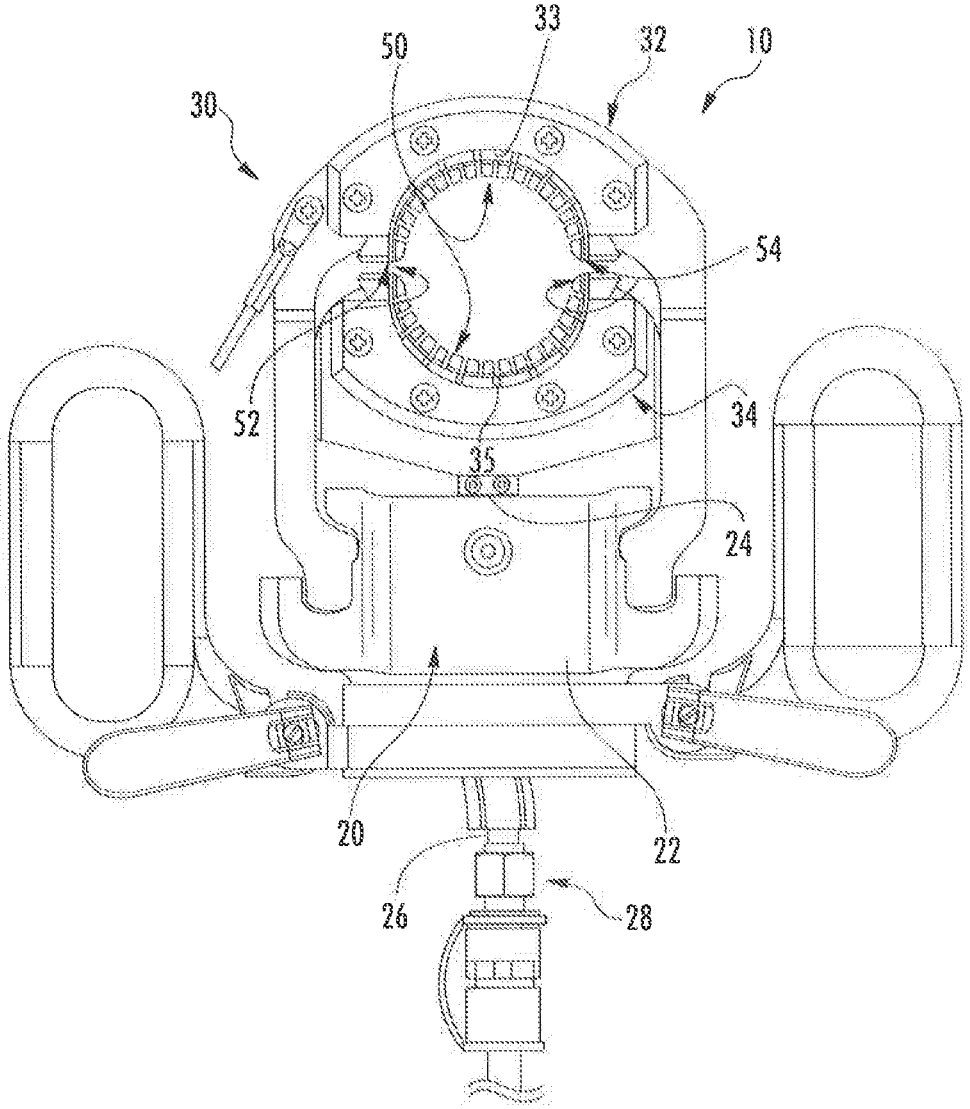
FIG. 1 is a front view of a swage press in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, a swage press 10 in accordance with the present disclosure is provided. The swage press 10 may include a cylinder 20 which includes a housing 22 and a piston 24. The cylinder 20 may be connected, via a suitable hose 26 and fitting assembly 28, to a pressurized fluid source. For example, in exemplary embodiments, the cylinder 20 may be a hydraulic cylinder, and the fluid source may be a liquid. Alternatively, the cylinder 20 may be a pneumatic cylinder, and the fluid source may be a gas.

Cylinder 20 may actuate a die block 30 which is connected to the cylinder 20. The die block 30 may generally be configured to accommodate a component assembly to be compressed, such as a pipe assembly and associated fitting. The die block 30 may include, for example, a head 32 and a jaw 34. The head 32 may, for example, be generally stationary while the jaw 34 is movably generally linearly towards and away from the head 32. The jaw 34 may, for example, be connected to the cylinder 20 to facilitate such movement. Movement of the jaw 34 towards the head 32 may cause compression of a component disposed between the head 32 and jaw 34.

Jaw 34 and head 32 may each include an inner surface 35, 33, respectively. The inner surfaces 33, 35 may be generally arcuate inner surfaces, as illustrated. The arcuate inner surfaces 33, 35 may together generally form a channel in which a component assembly to be compressed is provided for compression.

Die block 30 may further include a plurality of swage dies 50. In exemplary embodiments, a die block 30 may include two dies 50. A die 50 may be provided on each surface 33, 35. The dies 50 may contact a component assembly to be compressed, and may compress the components of the assembly, due to movement of the jaw 34 towards the head 32. Each die 50 may include a first end 52 and a second end 54. The first ends 52 may contact each other and the second ends 52 may contact each other as the jaw 34 moves towards the head 32. As the jaw 34 continues towards the head 32, the dies 50 may, due to the compressive forces exerted on each other, be compressed in a generally arcuate manner. Further, the component assembly between the dies 50 may be compressed together.

Figure 2:
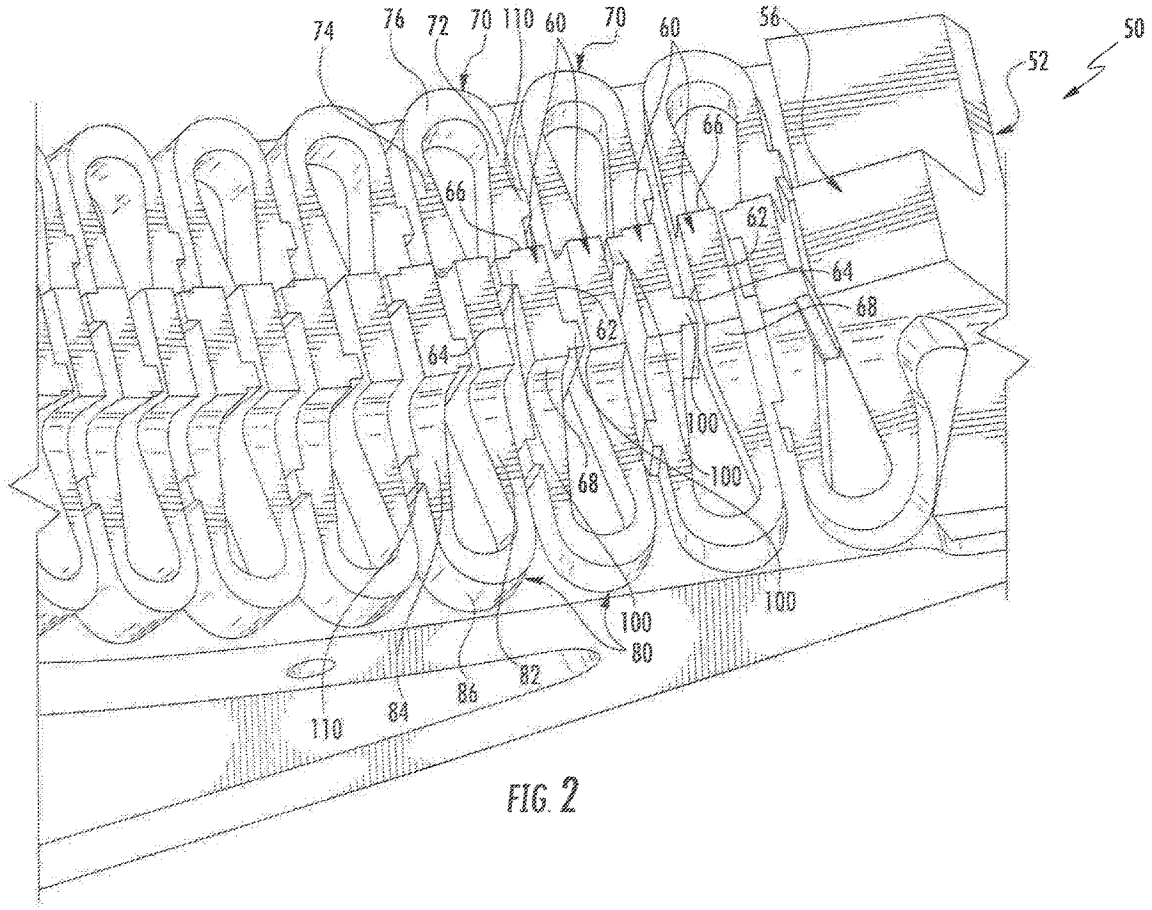
FIG. 2 is a top perspective view of a portion of a swage die in accordance with embodiments of the present disclosure.
Figure 3:
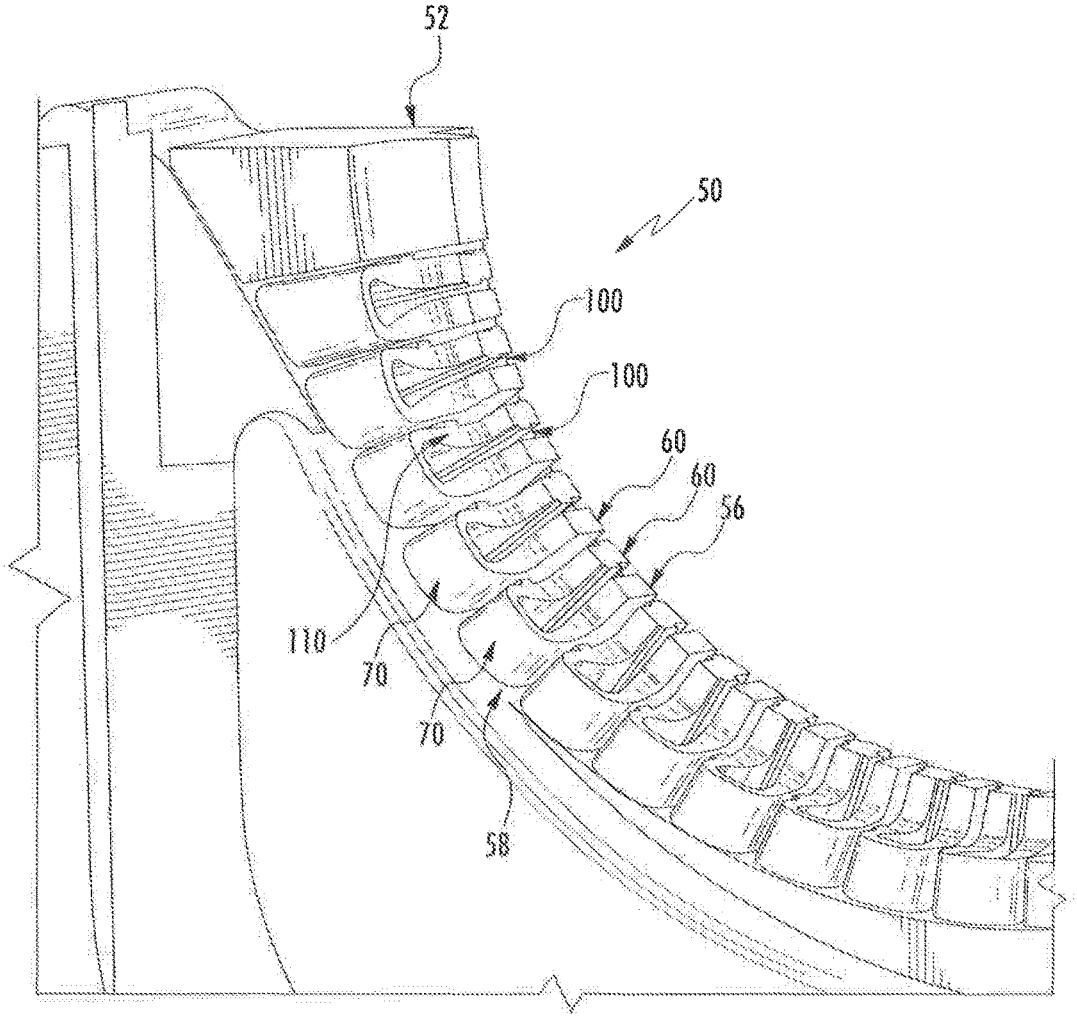
FIG. 3 is a side perspective view of a portion of a swage die in accordance with embodiments of the present disclosure.
Figure 4:
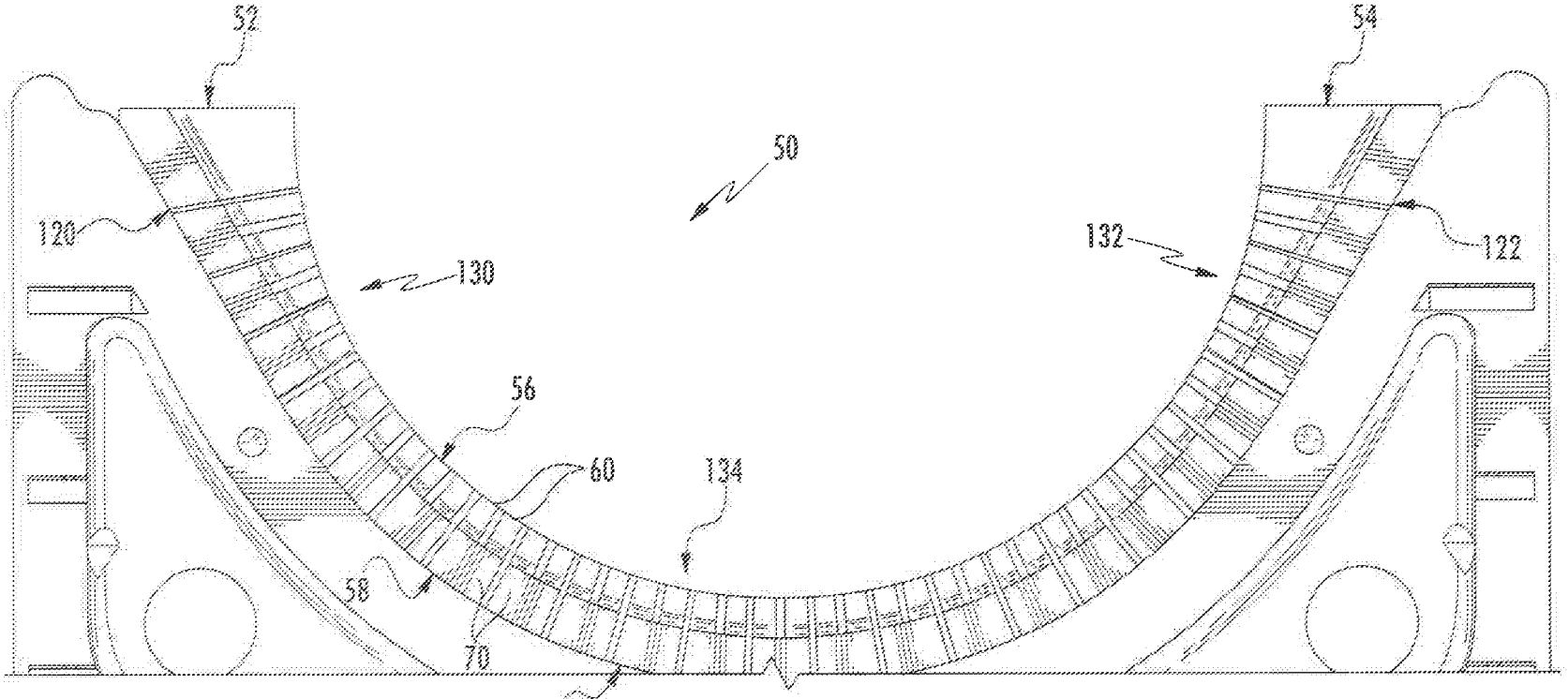
FIG. 4 is a side view of a portion of a swage die in accordance with embodiments of the present disclosure.

Referring now to FIGS. 2 through 4, swage dies 50 in accordance with the present disclosure are illustrated. Swage dies 50 in accordance with the present disclosure advantageously experience reduced stresses during compression in swage presses 10, thus minimizing the risk of failure during swaging operations. Further, swage dies 50 in accordance with the present disclosure advantageously require relatively less force for compression in a swaging process.

Additionally, due to the reduced stresses and required forces, relatively cheaper materials may be utilized. For example, in exemplary embodiments, dies 50 in accordance with the present disclosure may be formed from steel, such as from S7 tool steel, 4000 series steel (such as 4140, 4340, etc.), etc.

As illustrated, a die 50 in accordance with the present disclosure extends generally arcuately between a first end 52 and a second end 54. Die 50 further includes a top surface 56 and an opposing bottom surface 58. In general, the bottom surface, which is a generally arcuate surface, may contact an inner surface 33, 35 when assembled in a press 10. The top surface 56 (such as portions thereof which are part of the teeth of the die, as discussed herein) may contact one or more components of a component assembly being compressed.

Die 50 may further include a plurality of teeth 60 which are aligned in a generally arcuate array, as shown. Each tooth 60 may include a first sidewall 62, an opposing second sidewall 64, a first endwall 66, and an opposing second endwall 68. Sidewalls 62, 64 and endwalls 66, 68 in exemplary embodiments are generally planer, although alternatively sidewalls 62, 64 and/or endwalls 66, 68 may include generally curvilinear portions or be generally curvilinear. Each tooth 60 may additionally include a portion of the top surface 56 and a portion of the bottom surface 58 of the die 50. As discussed, the teeth 60 generally contact components of a component assembly being compressed, and transfer compressive forces from the press 10 generally to the component assembly to compress the component assembly.

During operation of the press 10, the teeth 60 are generally compressed arcuately towards each other. First and second supports disposed generally on opposing ends of the teeth may generally support the teeth and provide a biasing force against this arcuate compressive force, allowing the teeth 60 and die 50 generally to spring back in the generally arcuate direction to an unloaded position after being in such compressed, loaded position. Each support generally extends between and connects neighboring teeth, as shown.

For example, die 50 may include a plurality of first supports 70. Each of the plurality of first supports 70 may extend between and be connected to first endwalls 66 of neighboring (i.e. immediately next to) teeth 60. In exemplary embodiments as shown, each first support 70 may include a first leg 72, a second leg 74, and an arcuate connector 76. The first leg 72 may extend from and be connected to one of the neighboring teeth 60 (such as the endwall 66 thereof), and the second leg 74 may extend from and be connected to the other of the neighboring teeth 60 (such as the endwall 66 thereof). First leg 72 and second leg 74 may, for example, extend generally linearly and taper in thickness from the respective neighboring tooth 60 to which they are connected. The arcuate connector 76 may extend between and connect the first leg 72 and the second leg 74.

Die 50 may further include a plurality of second supports 80. Each of the plurality of second supports 80 may extend between and be connected to second endwalls 68 of neighboring (i.e. immediately next to) teeth 60. In exemplary embodiments as shown, each second support 80 may include a first leg 82, a second leg 84, and an arcuate connector 86. The first leg 82 may extend from and be connected to one of the neighboring teeth 60 (such as the endwall 68 thereof), and the second leg 84 may extend from and be connected to the other of the neighboring teeth 60 (such as the endwall 68 thereof). First leg 82 and second leg 84 may, for example, extend generally linearly and taper in thickness from the respective neighboring tooth 60 to which they are connected. The arcuate connector 86 may extend between and connect the first leg 82 and the second leg 84.

Each of the plurality of teeth 60, first supports 70 and second supports 80 may have a height 61, 71, 81, respectively. The heights 61, 71, 81 may be defined as the maximum linear distance between the bottom surface 58 and the top surface 56 for the subject tooth 60, first support 70 or second support 80. In exemplary embodiments, the height 61 of each of the plurality of teeth 60 may be greater than the heights 71, 81 of the first support 70 and second support 80 connected to that tooth 60. Further, in exemplary embodiments, the height 61 of each of the plurality of teeth 60 may be greater than the heights 71, 81 of each of the plurality of first supports 70 and second supports 80.

As further illustrated, die 50 may include a plurality of stops 100, which may be referred to as first stops 100. Each stop 100 may generally protrude from a sidewall of a tooth 60 towards the sidewall of a neighboring tooth 60. Stops 100 advantageously transmit compressive forces therethrough during operation of an associated press 10 and reduce stresses within the teeth 60 and die 50 generally.

As shown, each of the plurality of stops 100 may extend from the first sidewall 62 of a tooth 60 towards the second sidewall 64 of a neighboring tooth 60, or from the second sidewall of a tooth 60 towards the first sidewall 62 of a neighboring tooth 60. When the die 50 is in an unloaded position, the stops 100 may be spaced from the sidewalls of the neighboring teeth 60 towards which they extend. When the die 50 is in a loaded position, the stops 100 may contact the sidewalls of the neighboring teeth 60.

In some embodiments, each tooth 60 may include a stop 100 extending therefrom. For example, all stops 100 may extend from the first sidewalls 62 of the teeth 60 or all stops 100 may extend from the second sidewalls 62 of the teeth 60, or any other suitable combination thereof. Alternatively, as illustrated, some teeth 60 may include one or more stops 100 extending therefrom, while other teeth 60 do not include stops 100. For example, as shown, a first subset of the plurality of teeth 60 each includes one or more stops 100. In exemplary embodiments, each tooth 60 of the first subset includes a stop 100 extending from the first sidewall 62 of the tooth 60 towards the second sidewall 64 of a neighboring tooth 60 and a stop 100 extending from the second sidewall of the tooth 60 towards the first sidewall 62 of a neighboring tooth 60. Further, in exemplary embodiments, a second subset of plurality of teeth 60 (which includes teeth 60 not in the first subset) may each include no stops 100. The neighboring teeth 60 of those teeth 60 in the first subset may be the teeth in the second subset. For example, the teeth 60 in the first and second subsets may be arranged in an alternating arrangement, as shown.

In exemplary embodiments, die 50 may further include a plurality of second stops 110. Each stop 100 may generally protrude from first support 70 or second support 80 towards a neighboring first support 70 or second support 80, respectively. Stops 110 advantageously transmit compressive forces therethrough during operation of an associated press 10 and reduce stresses within the supports 70, 80 and die 50 generally.

As shown, each of the plurality of stops 110 may extend from a first support 70 towards a neighboring first support 70 or from a second support 80 towards a neighboring second support 80. When the die 50 is in an unloaded position, the stops 110 may be spaced from the neighboring supports 70, 80 towards which they extend. When the die 50 is in a loaded position, the stops 110 may contact the neighboring supports 70, 80.

Each stop 110 in exemplary embodiments may extend from the first leg 72, second leg 74, first leg 82 and/or second leg 84. For example, in some embodiments as illustrated stops 110 extending from the first supports 70 may each extend from a second leg 74 thereof, and stops 110 extending from the second supports 80 may extend from a first leg 82 thereof. Alternatively, some supports 70 and/or 80 may include multiple stops 110 extending therefrom, such as from both first and second legs 72, 74 and/or 82, 84, and some supports 70 and/or 80 may not include any stops 110 extending therefrom.

When viewed from the side, such as shown in FIG. 4, dies 50 in accordance with the present disclosure may have advantageous configurations that provide further stress reduction by advantageously reducing the forces required to compress the dies 50. For example, bottom surface 58 of die 50 may include a first end portion 120, a second end portion 122, and an intermediate portion 124. The first end portion 120 may extend from the first end 52, and the second end portion 122 may extend from the second end 54. The intermediate portion 124 may extend between and connect the first end portion 120 and second end portion 122. In exemplary embodiments, the intermediate portion 124 may, when viewed in a side view as shown, have a generally constant radius. Further, in exemplary embodiments, the first end portion 120 and the second end portion 122 may each, when viewed in a side view as shown, extend generally linearly and at a generally constant angle from the intermediate portion 124. Such angles may be defined relative to a tangent line to the intersection of the intermediate portion 124 with the first end portion 120 and/or second end portion 122.

It should be noted that in alternative embodiments, the first end portion 120 and second end portion 122 may have generally constant radii, which may he equal to the radius of the intermediate portion 124.

The top surface 56 of the die 50 may, as discussed, include a portion defined by the plurality of teeth 60 and portions defined by the plurality of first supports 70 and second supports 80. In exemplary embodiments as shown, the portion of the top surface 56 defined by the plurality of teeth 60 (i.e. the entire portion) may have a generally constant radius.

The portions of the top surface 56 defined by the plurality of first supports 70 and second supports 80 may, in some embodiments, be similar to the bottom surface 58. For example, these portions of the top surface 56 may each include a first end portion 130, a second end portion 132, and an intermediate portion 134. The first end portion 130 may extend from the first end 52, and the second end portion 132 may extend from the second end 54. The intermediate portion 134 may extend between and connect the first end portion 130 and second end portion 132. In exemplary embodiments, the intermediate portion 134 may, when viewed in a side view as shown, have a generally constant radius. Further, in exemplary embodiments, the first end portion 130 and the second end portion 132 may each, when viewed in a side view as shown, extend generally linearly and at a generally constant angle from the intermediate portion 134. Such angles may be defined relative to a tangent line to the intersection of the intermediate portion 134 with the first end portion 130 and/or second end portion 132.

It should be noted that in alternative embodiments, the first end portion 130 and second end portion 132 may have generally constant radii, which may be equal to the radius of the intermediate portion 134.

Figure 5:
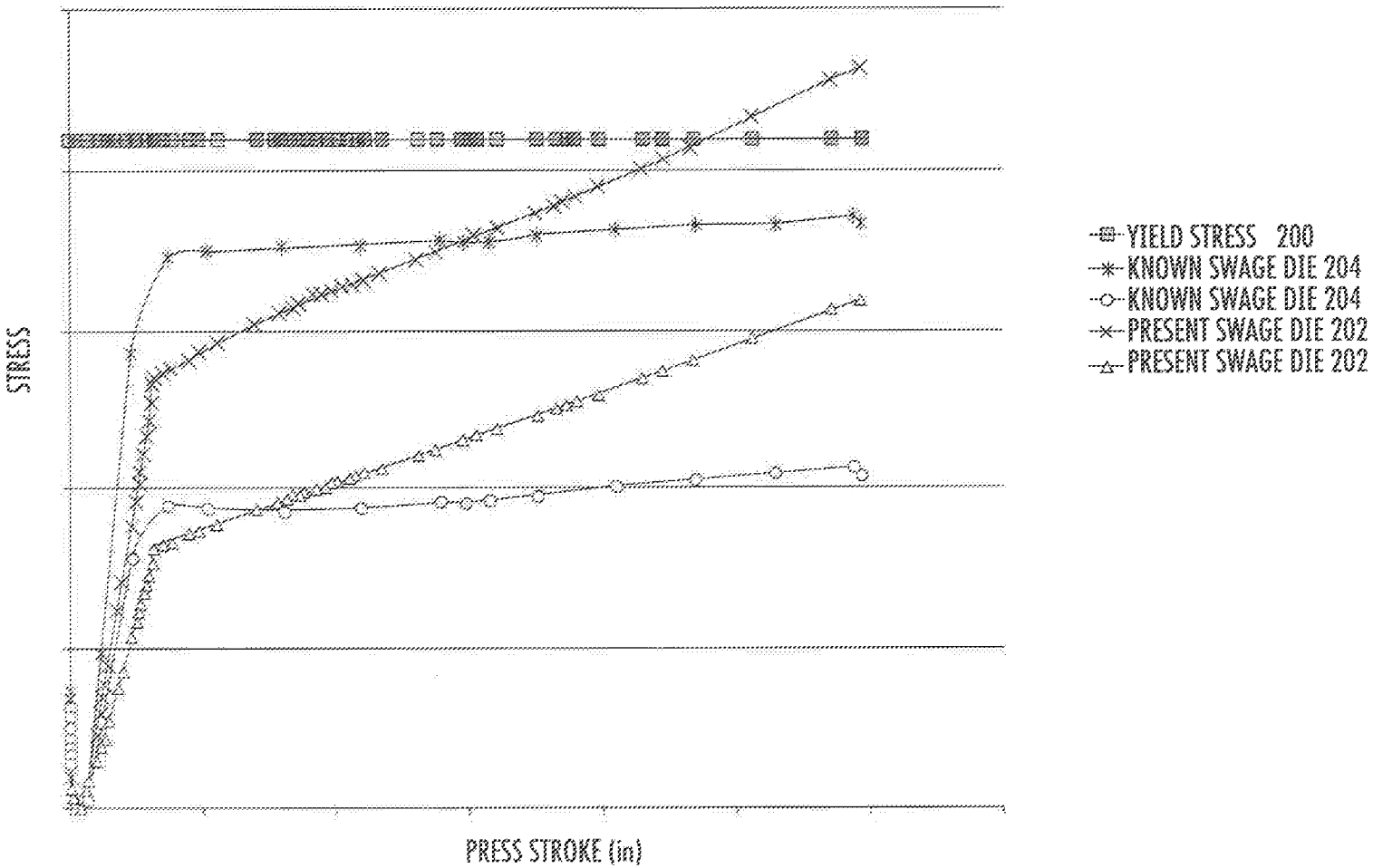
FIG. 5 is a graph illustrating stress levels as functions of swage press strokes for swage dies in accordance with embodiments of the present disclosure.

Referring now to FIG. 5. a graph illustrating stress levels as functions of swage press strokes for various swage dies is provided. Line 200 indicates the yield stress for the material from which the tested swage dies were formed, in this case 57 tool steel. Lines 202 indicate locations at which stresses were measured on a swage die in accordance with embodiments of the present disclosure, while lines 204 indicate the same locations at which stresses were measured on a prior art swage die. As illustrated, the stresses on the swage die formed in accordance with embodiments of the present disclosure were reduced relative to those on the prior art swage die. Further, stresses advantageously stayed below the yield stress level throughout the entire stroke of the swage press.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A swage die, comprising:

a plurality of teeth aligned in a generally arcuate array, each tooth of the plurality of teeth comprising a first sidewall, an opposing second sidewall, a first endwall, and an opposing second endwall;

a plurality of first supports, each of the plurality of first supports extending between and connected to first endwalls of neighboring teeth;

a plurality of second supports, each of the plurality of second supports extending between and connected to second endwalls of neighboring teeth;

a plurality of stops, each of the plurality of stops extending from the first sidewall of a tooth towards the second sidewall of a neighboring tooth or from the second sidewall of a tooth towards the first sidewall of a neighboring tooth.

2. The swage die of claim 1, wherein a first subset of the plurality of teeth each include a stop extending from the first sidewall of the tooth towards the second sidewall of a neighboring tooth and from the second sidewall of the tooth towards the first sidewall of a neighboring tooth.

3. The swage die of claim 2, wherein the neighboring teeth are a second subset of the plurality of teeth each including no stops.

4. The swage die of claim 1, wherein a height of each of the plurality of teeth is greater than a height of each of the plurality of first supports and each of the plurality of second supports.

5. The swage die of claim 1, wherein the stops are first stops, and further comprising a plurality of second stops, each of the plurality of second stops extending from a first support towards a neighboring first support or from a second support towards a neighboring second support.

6. The swage die of claim 5, wherein each of the plurality of first supports and each of the plurality of second supports comprises a first leg, a second leg, and an arcuate connector extending between and connecting the first leg and the second leg.

7. The swage die of claim 6, wherein each of the plurality of second stops extends from a first leg or a second leg.

8. The swage die of claim 1, further comprising a bottom surface and a top surface, the bottom surface comprising a first end portion extending from a first end, a second end portion extending from a second end, and an intermediate portion extending between and connecting the first end portion and the second end portion, the intermediate portion having a generally constant radius, the first end portion and the second end portion each extending at a generally constant angle from the intermediate portion.

9. The swage die of claim 8, wherein a portion of the top surface defined by the plurality of teeth has a generally constant radius.

10. A swage die, comprising:

a plurality of teeth aligned in a generally arcuate array, each tooth of the plurality of teeth comprising a first sidewall, an opposing second sidewall, a first endwall, and an opposing second endwall;

a plurality of first supports, each of the plurality of first supports extending between and connected to first endwalls of neighboring teeth;

a plurality of second supports, each of the plurality of second supports extending between and connected to second endwalls of neighboring teeth;

a top surface; and a bottom surface, the bottom surface comprising a first end portion extending from a first end, a second end portion extending from a second end, and an intermediate portion extending between and connecting the first end portion and the second end portion, the intermediate portion having a generally constant radius, the first end portion and the second end portion each extending at a generally constant angle from the intermediate portion.

11. The swage die of claim 10, wherein a portion of the top surface defined by the plurality of teeth has a generally constant radius.

12. The swage die of claim 10, further comprising a plurality of stops, each of the plurality of stops extending from the first sidewall of a tooth towards the second sidewall of a neighboring tooth or from the second sidewall of a tooth towards the first sidewall of a neighboring tooth.

13. The swage die of claim 12, wherein a first subset of the plurality of teeth each include a stop extending from the first sidewall of the tooth towards the second sidewall of a neighboring tooth and from the second sidewall of the tooth towards the first sidewall of a neighboring tooth.

14. The swage die of claim 12, wherein the stops are first stops, and further comprising a plurality of second stops, each of the plurality of second stops extending from a first support towards a neighboring first support or from a second support towards a neighboring second support.

15. The swage die of claim 14, wherein each of the plurality of first supports and each of the plurality of second supports comprises a first leg, a second leg, and an arcuate connector extending between and connecting the first leg and the second leg.

16. The swage die of claim 15, wherein each of the plurality of second stops extends from a first leg or a second leg.

17. A swage press, comprising;

a cylinder comprising a housing and a piston; and a die block connected to the cylinder, the die block comprising a head, a jaw, and a plurality of dies, each of the plurality of dies comprising:

a plurality of teeth aligned in a generally arcuate array, each tooth of the plurality of teeth comprising a first sidewall, an opposing second sidewall, a first endwall, and a second opposing endwall;

a plurality of first supports, each of the plurality of first supports extending between and connected to first endwalls of neighboring teeth;

a plurality of second supports, each of the plurality of second supports extending between and connected to second endwalls of neighboring teeth;

a plurality of stops, each of the plurality of stops extending from the first sidewall of a tooth towards the second sidewall of a neighboring tooth or from the second sidewall of a tooth towards the first sidewall of a neighboring tooth.

18. The swage press of claim 17, wherein the stops are first stops, and further comprising a plurality of second stops, each of the plurality of second stops extending from a first support towards a neighboring first support or from a second support towards a neighboring second support.

19. The swage press of claim 17, further comprising a bottom surface and a top surface, the bottom surface comprising a first end portion extending from a first end, a second end portion extending from a second end, and an intermediate portion extending between and connecting the first end portion and the second end portion, the intermediate portion having a generally constant radius, the first end portion and the second end portion each extending at a generally constant angle from the intermediate portion.

20. The swage press of claim 17, wherein the cylinder is a hydraulic cylinder.

* * * * *